US011578949B1

(12) United States Patent
Olson et al.

(10) Patent No.: US 11,578,949 B1
(45) Date of Patent: Feb. 14, 2023

(54) QUICK RELEASE FOR BALLISTIC SHIELD

(71) Applicant: Bunker Supply Co., LLC, Goleta, CA (US)

(72) Inventors: Ryan Olson, Goleta, CA (US); Jared Naito, Santa Barbara, CA (US); Marco Vanella, Goleta, CA (US)

(73) Assignee: Bunker Supply Co., LLC, Goleta, CA (US)

( * ) Notice: Subject to any disclaimer, the term of this patent is extended or adjusted under 35 U.S.C. 154(b) by 0 days.

(21) Appl. No.: 17/859,948

(22) Filed: Jul. 7, 2022

Related U.S. Application Data

(60) Provisional application No. 63/223,884, filed on Jul. 20, 2021.

(51) Int. Cl.
*F41H 5/013* (2006.01)
*F41H 1/02* (2006.01)

(52) U.S. Cl.
CPC ..... *F41H 5/013* (2013.01); *F41H 1/02* (2013.01)

(58) Field of Classification Search
CPC ..... F41H 1/02; F41H 5/013
See application file for complete search history.

(56) References Cited

U.S. PATENT DOCUMENTS 4,079,464 A * 3/1978 Roggin ..... F41H 1/02 2/2.5
5,060,314 A * 10/1991 Lewis ..... A62B 17/003 2/2.5
6,769,137 B2 * 8/2004 D'Annunzio ..... F41H 1/02 2/102
7,424,748 B1 * 9/2008 McDunn ..... F41H 1/02 2/2.5
7,979,917 B2 * 7/2011 Osborne ..... F41H 1/02 2/2.5
9,222,757 B2 12/2015 Seuk
9,949,514 B2 * 4/2018 Gill ..... A41F 1/00
10,845,163 B2 * 11/2020 Nardone ..... A41D 31/24
2005/0005342 A1 * 1/2005 Johnson ..... F41H 1/02 2/102
2005/0005343 A1 * 1/2005 Johnson ..... F41H 1/02 2/102

(Continued)

OTHER PUBLICATIONS

Highcom Armor Solutions, Inc., "Guardian Spall Sleeve—Rifle Insert Spall Sleeve," Highcomarmor.com, copyright 2021, 1 page.

*Primary Examiner* — Joshua E Freeman
(74) *Attorney, Agent, or Firm* — SoCal IP Law Group LLP; Guy Cumberbatch; Steven C. Sereboff

(57) ABSTRACT

A quick-release ballistic plate assembly for a protective vest includes an outer chassis configured to attach to a chest and/or back panel of the vest. The outer chassis has an open lower end leading to an inner cavity, wherein a ballistic plate and sleeve subassembly inserts upward into the cavity. An emergency release handle depending downward from the subassembly may be pulled to overcome a retention mechanism and jettison the subassembly in case the wearer ends up in a body of water or alternative situation requiring such function. This avoids the need to shed the entire protective vest which typically has numerous pockets for a variety of tools, survival gear and ammunition. The assembly may be built into the protective vest at the OEM level, or may be retrofit to existing vests.

22 Claims, 11 Drawing Sheets

(56) References Cited

U.S. PATENT DOCUMENTS

| | | | | |
|---|---|---|---|---|
| 2008/0120819 | A1* | 5/2008 | Rene | A41D 13/0012 2/2.5 |
| 2008/0263737 | A1* | 10/2008 | Parks | F41H 1/02 2/2.5 |
| 2009/0282595 | A1* | 11/2009 | Branson | F41H 1/02 2/2.5 |
| 2010/0025560 | A1* | 2/2010 | Beck | A45F 5/02 248/558 |
| 2010/0205708 | A1* | 8/2010 | Storms, Jr. | A41D 13/05 2/2.5 |
| 2010/0223705 | A1* | 9/2010 | Osborne | F41H 1/02 2/2.5 |
| 2010/0287681 | A1* | 11/2010 | Storms, Jr. | F41H 1/02 2/102 |
| 2011/0072566 | A1* | 3/2011 | Kovacevich | F41H 1/02 2/2.5 |
| 2011/0094006 | A1* | 4/2011 | Cole | F41H 1/02 2/102 |
| 2012/0132065 | A1* | 5/2012 | Seuk | F41H 1/02 89/36.05 |
| 2012/0167267 | A1* | 7/2012 | Osman | F41H 1/02 2/2.5 |
| 2012/0174286 | A1* | 7/2012 | McBride | F41H 1/02 2/102 |
| 2012/0174764 | A1 | 7/2012 | Medwell | |
| 2012/0180178 | A1* | 7/2012 | Gallo | F41H 1/02 2/2.5 |
| 2016/0138894 | A1 | 5/2016 | Heise | |
| 2020/0333111 | A1* | 10/2020 | Ward | A41D 13/0002 |

* cited by examiner

QUICK RELEASE FOR BALLISTIC SHIELD

RELATED APPLICATIONS

The patent claims priority to U.S. Provisional Application No. 63/223,884, filed Jul. 20, 2021 which is incorporated herein by reference.

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to a universal insert compatible across protective vest platforms and a retrofit kit that is specific to a vest platform enabling quick release for a ballistic shield within the vest.

Description of the Related Art

A ballistic vest or bullet-resistant vest, often called a bulletproof vest or plate carrier, is an item of personal armor worn on the torso that helps absorb the impact and reduce or stop penetration to the body from firearm-fired projectiles. Soft armor vests are made of many layers of woven or laminated fibers and can protect the wearer from small-caliber handgun and shotgun projectiles. These vests often have a ballistic plate inserted into the vest. Metal or ceramic plates can be used with a soft vest, providing additional protection against rifle rounds.

Hard-plate reinforced vests are mainly worn by combat soldiers, police tactical units, and hostage rescue teams but are becoming increasingly popular also among civilian users. Hard-plate reinforced vests may include an exterior pocket that is sized to accommodate the hard plate and that protrudes from an outer face of the vest. If the wearer of the vest ends up in a body of water, the heavy ballistic plate(s) presents a serious buoyancy issue, requiring the wearer to immediately discard the vest or risk drowning. A major drawback with such an emergency decision is that the vest typically has numerous pockets for a variety of tools, survival gear and ammunition, so that jettisoning the vest saves the wearer's life but at a high cost.

There is thus a need for an improved protective vest.

Throughout this description, elements appearing in figures are assigned three-digit reference designators, where the most significant digit is the figure number and the two least significant digits are specific to the element. An element that is not described in conjunction with a figure may be presumed to have the same characteristics and function as a previously-described element having a reference designator with the same least significant digits.

DETAILED DESCRIPTION

A quick-release ballistic plate assembly for a protective vest includes an outer chassis configured to attach to a chest panel and/or back panel of the vest is disclosed. The outer chassis has an open lower end leading to an inner cavity, wherein a ballistic plate and sleeve subassembly inserts upward into the cavity. An emergency release handle depending downward from the subassembly may be pulled to overcome a retention mechanism and jettison the subassembly in case the wearer ends up in a body of water. This avoids the need to shed the entire protective vest which typically has numerous pockets for a variety of tools, survival gear and ammunition. The assembly may be built into the protective vest at the OEM level, or may be retrofit to existing vests.

A quick-release ballistic plate assembly for a protective vest, comprising an outer chassis having a pair of flexible flat panels connected together at outer top and side edges thereof, with aligned lower edges unconnected to define a lower mouth leading upward to an inner cavity between the panels, the outer chassis having attachment structure thereon for mounting to the protective vest. A ballistic plate and sleeve subassembly has a rigid ballistic plate held within a flat sleeve made of low friction polymer, and the subassembly is sized to fit through the open mouth of the outer chassis into the cavity. The subassembly has an emergency release handle centered on one end thereof. A subassembly retention mechanism has a release cable fixed to the emergency release handle that passes laterally outward through a plurality of flexible retention loops hanging down from the aligned lower edges of the outer chassis. Opposite lateral ends of the release cable are affixed to the outer chassis by safety ties or other retention device such as snaps having sufficient strength to retain the release cable in place against a weight of the subassembly while being configured to break from manual downward pulling on the emergency release handle.

Further advantages, features and details of the invention will be apparent from the following description, in which examples of embodiments of the invention are described in detail with reference to the drawings. In this context, the features mentioned in the claims and in the description may each be essential to the invention individually or in any combination.

Figure 1B:
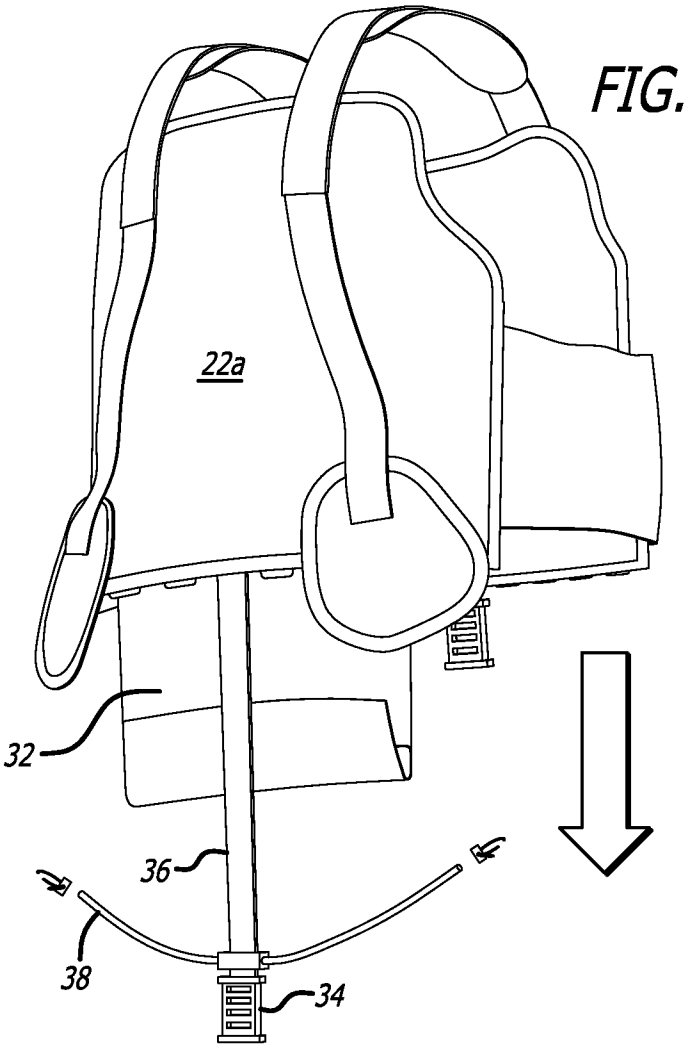
FIG. 1B shows a ballistic plate and sleeve subassembly being separated from the vest.
Figure 1A:
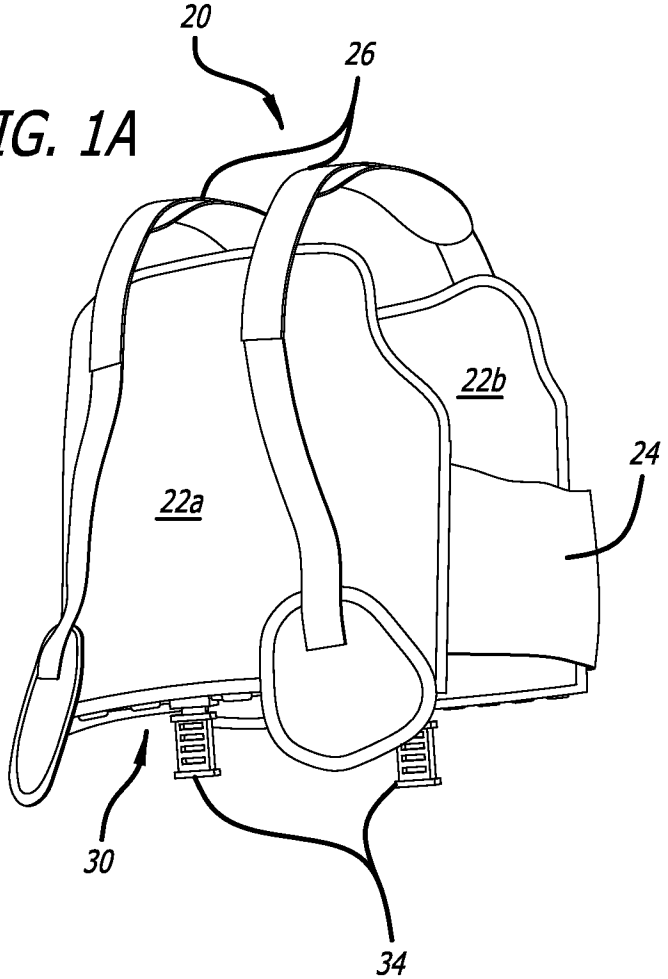
FIG. 1A is a perspective view of a protective vest outfitted with a quick-release ballistic plate assembly.

FIG. 1A is a perspective view of a protective vest 20 outfitted with a quick-release ballistic plate assembly of the present application. The protective vest 20 is representative of a number of similar vests, and includes front chest and rear back panels 22*a*, 22*b* connected via side belts 24, and having a pair of shoulder straps 26 attached to outer faces and looping over the top of both panels. Although not shown, typical protective vests 20 of this nature feature a plurality of loops or pockets for containing ammunition, survival gear, or the like. This type of vest is often known in the industry as CMU-37 or CMU-38.

FIG. 1A shows, at the bottom end of both panels 22*a*, 22*b*, a lower end of a quick-release ballistic plate assembly 30. FIG. 1B shows a ballistic plate and sleeve subassembly 32 being separated from the vest 20. The assembly 30 includes an emergency release handle 34 at the lower end of a pull strap 36 attached (e.g., sewn) to the exterior of the plate and sleeve subassembly 32. Pulling down on the emergency release handle 34 rapidly releases the subassembly 32 which, by virtue of its weight and slight manual pull assistance, drops straight down, thus separating it from the vest 20. Pulling down on the release handle 34 pulls free a release cable 38 that retains the plate and sleeve subassembly 32 within the vest 20.

Figure 3:
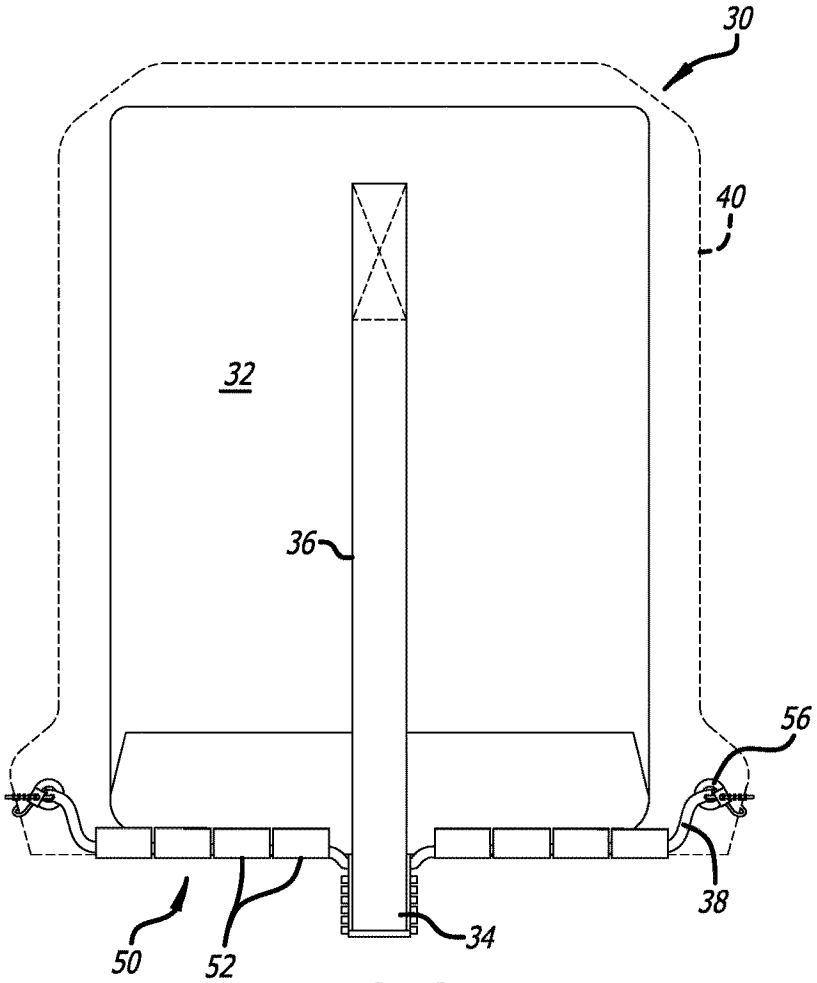
FIG. 3 is a similar view with an outer chassis shown in phantom to visualize an inner ballistic plate and sleeve subassembly.
Figure 2:
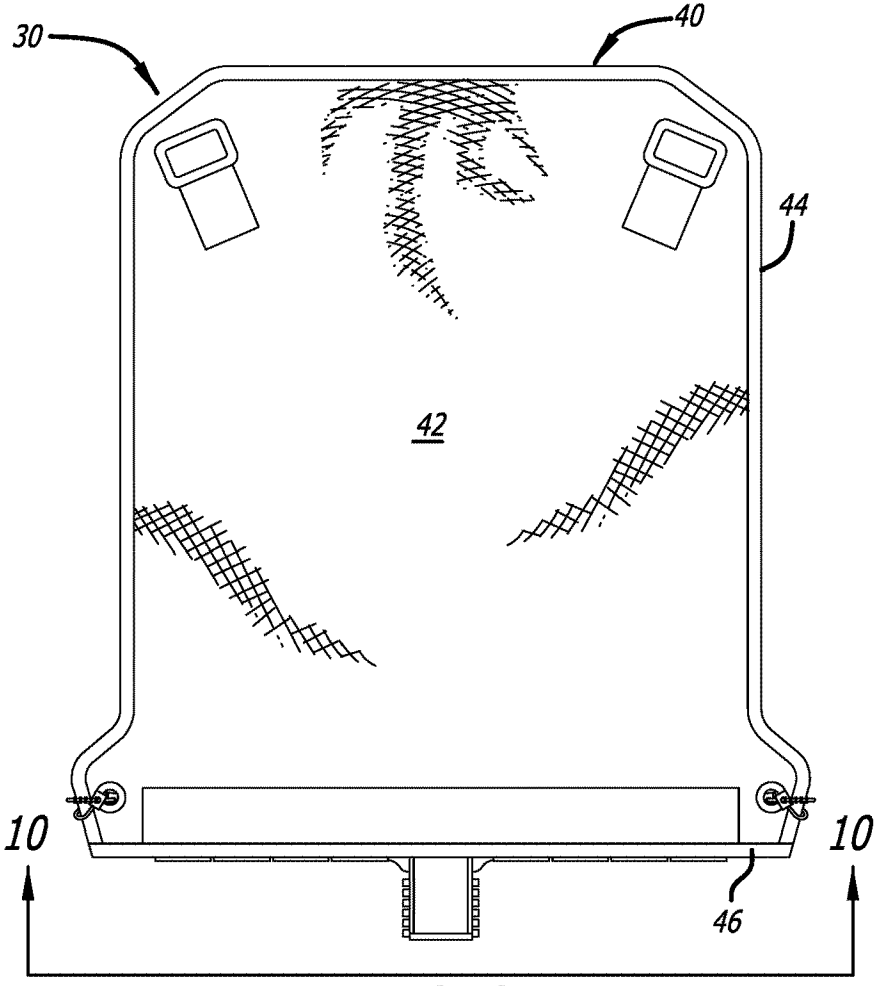
FIG. 2 is an elevational view of the quick-release ballistic plate assembly.

FIG. 2 is an elevational view of the quick-release ballistic plate assembly 30, and FIG. 3 is a similar view with an outer chassis 40 shown in phantom to visualize the inner ballistic plate and sleeve subassembly 32. The outer chassis 40 comprises a generally rectangular flat unit formed of front and rear flexible (e.g., fabric) panels 42 connected together at their top and side edges 44. The bottom edges 46 of the panels 42 are left unconnected so as to form an open lower mouth therebetween that leads upward into a cavity between the panels. The outer chassis 40 may be made of panels of 1000D water repellent, flame-retardant nylon (MIL-DTL-32439 Type I, Class 4), which is a tough, pliable material used extensively in aircrew vests and other flight gear, and is a proven petroleum, oil, lubricant (POL) and flame-resistant material suitable for naval aviation use.

After the plate and sleeve subassembly 32 is placed within the inner cavity of the outer chassis 40 through the lower mouth, a retention mechanism 50 described below supports the weight of the subassembly 32 from falling out. The emergency release handle 34 projects downward below the lower edges 46 for easy grasping.

FIG. 3 shows the retention mechanism 50 which includes the aforementioned release cable 38 fixedly attached to the emergency release handle 34 or pull strap 36. Pull strap 36 is affixed to the plate sleeve via stitching, adhesive, or other method. The release cable 38 extends laterally outward in both directions from the central release handle 34 and passes through a series of retention loops 52 attached to the lower edges 46 of the chassis panels 42. The release cable 38 is then secured at its outer ends to the chassis 40. More specifically, the release cable 38 has holes 39 (see FIG. 4C) at each outer end through which safety ties 54 or an alternative retention device (e.g., snaps) pass. Safety ties 54, in turn, loop through the eyelets 56 extending through both panels 42 of the chassis 40. The safety ties 54 may be configured similar to zip ties, with a ratchet-type tightening mechanism. The safety ties 54 or other retention device are configured to have a nominal strength which retains the release cable 38 in the position illustrated in FIG. 3, but which is relatively easy to break upon yanking the emergency release handle 34 downward. More particularly, the safety ties 54 have sufficient strength to retain the release cable 38 in place against a weight of the subassembly 32 while being configured to break from manual downward pulling on the emergency release handle 34. Reference is made to FIG. 1B showing the plate and sleeve subassembly 32 falling out of the chassis 40 (fastened to the inside of front chest panel 22*a*).

FIGS. 4A-4F are perspective views of a lower end of the outer chassis 40 illustrating several steps in assembling the inner ballistic plate and sleeve subassembly 32 therewith. The outer chassis 40 is shown inserted into an interior pocket formed by the front chest panel 22*a* of the protective vest 20, though as will be seen below the chassis 40 could also be attached to an inner wall of the chest.

Figure 4A:
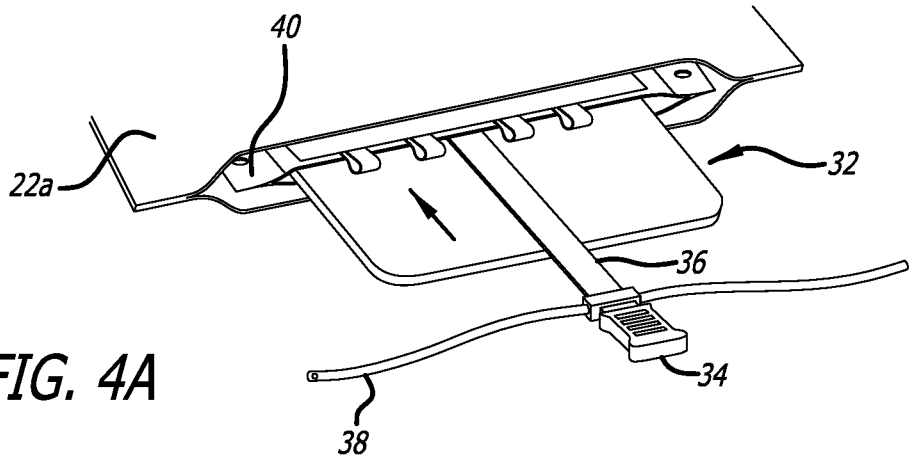
FIGS. 4A-4F are perspective views of a lower end of the outer chassis of the quick-release ballistic plate assembly illustrating several steps in assembling the sleeve subassembly within the chassis.
Figure 4B:
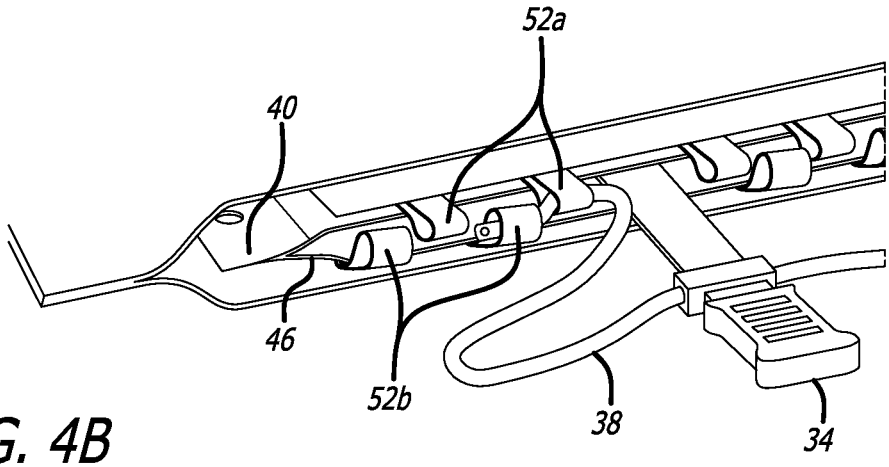

In a first step of assembly, in FIG. 4A, the plate and sleeve subassembly 32 is inserted within the inner cavity of the chassis 40. With the subassembly 32 mostly inserted, the assembler threads the release cable 38 sequentially outward through the retention loops 52*a*, 52*b* on both sides of the release handle 34, as in FIG. 4B. The retention loops 52*a*, 52*b* on the opposite lower edges 46 of the chassis 40 are interlaced such that the release cable 38 passes through loops on alternating edges until it is in the position shown in FIG. 4C.

Figure 4C:
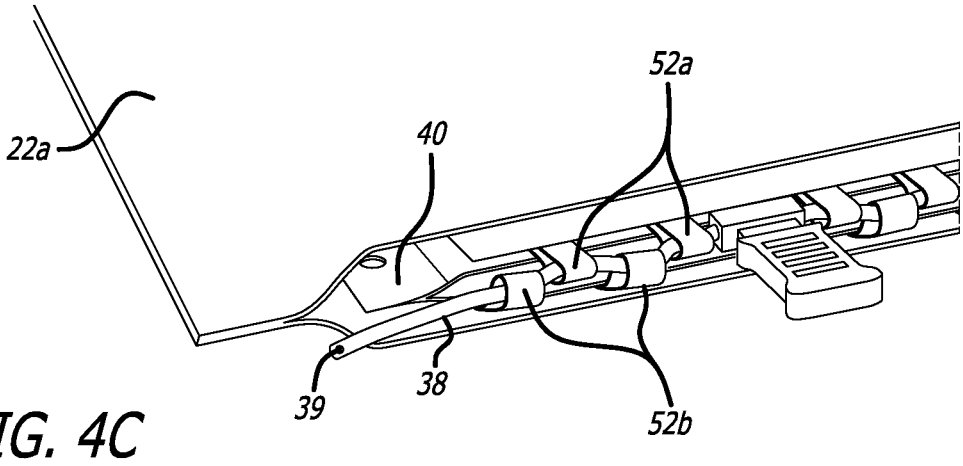
Figure 4D:
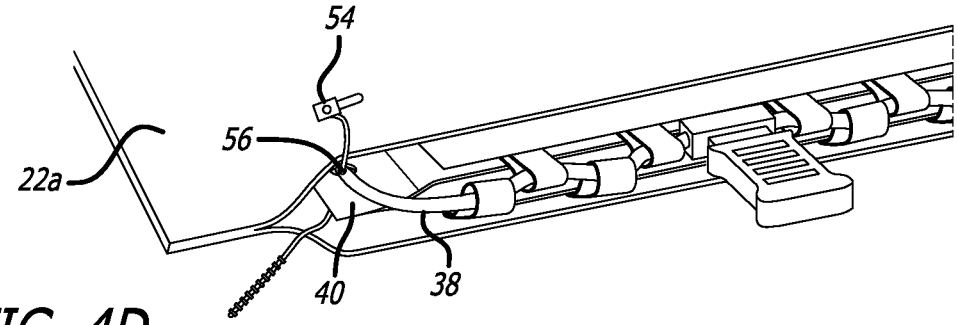
Figure 4E:
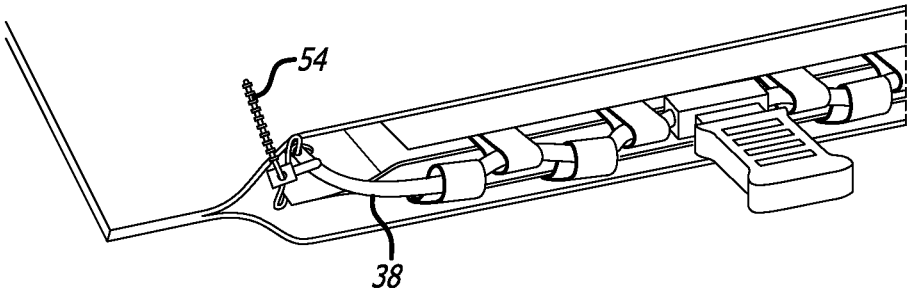
Figure 4F:
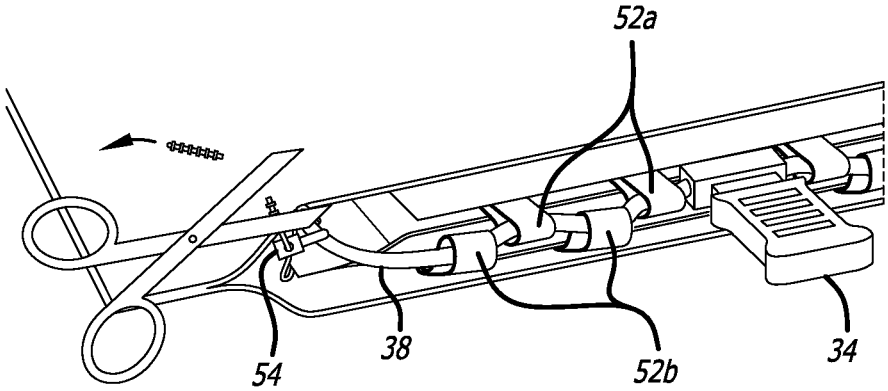

With reference to FIGS. 4C and 4D, a safety tie 54 is then inserted through the hole 39 at the end of the release cable 38, and through the eyelet 56 at the lower corner of the chassis 40. Once the safety tie 54 has been closed, as in FIG. 4E, the plate sleeve subassembly 32 is secured within the chassis 40. FIG. 4F shows an optional step of trimming the free end of the safety tie 54.

Figure 5:
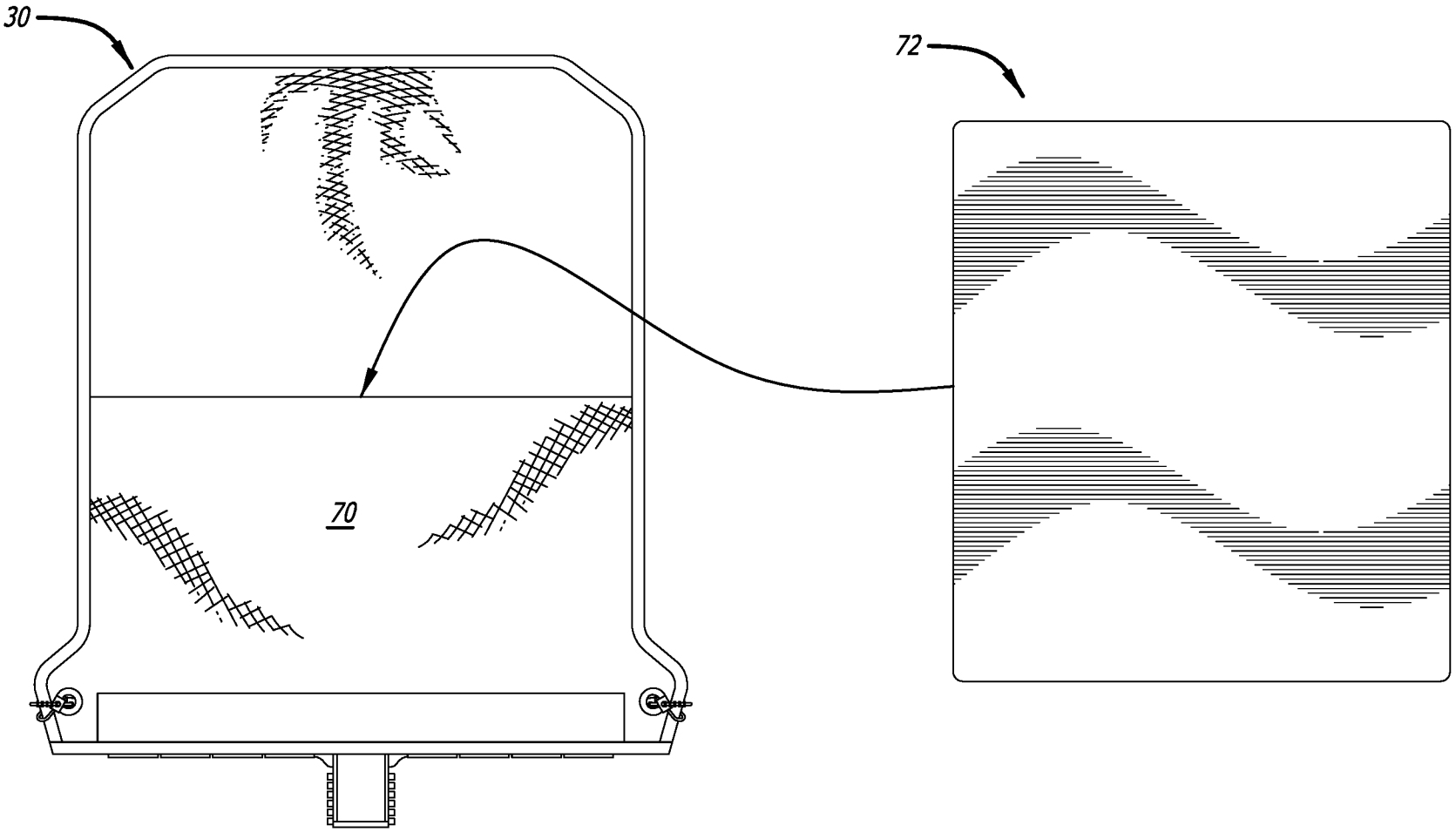
FIG. 5 is an elevational view of the quick-release ballistic plate assembly showing addition of a soft armor protective plate.

FIG. 5 is an elevational view of a rear face of the quick-release ballistic plate assembly 30. The assembly 30 may be provided with a larger pocket 70 into which a soft armor protective plate 72 can be inserted and secured with overlapping panels. Soft plates 72 made of tough material such as Kevlar are often used when a rigid ballistic plate is not necessary or in conjunction to further enhance ballistic protection.

Figure 6:
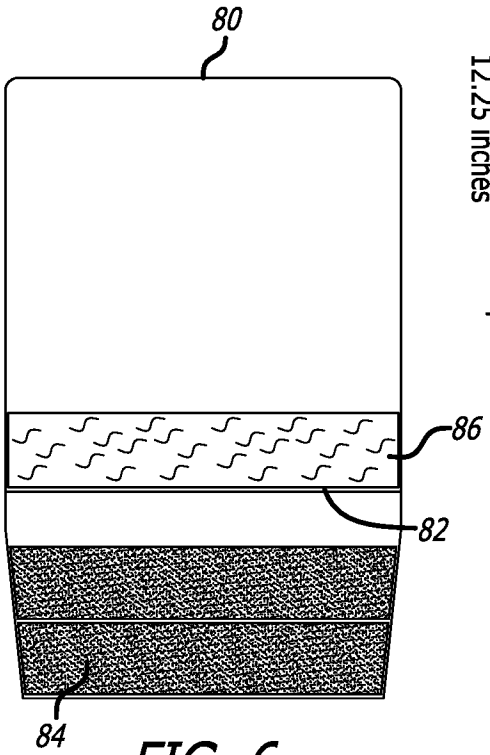
FIG. 6 is an elevational view of a ballistic plate sleeve having a lower end opened up.

FIG. 6 is an elevational view of a ballistic plate sleeve 80 having a lower end 82 opened up. The plate sleeve 80 has an enlarged loose closure flap 84 with one component of a hook and loop fastening patch thereon which meets with the other component in the form of a strip 86 on the exterior of the sleeve. The closure flap 84 has a larger longitudinal dimension than the strip 86 so that the flap may mate with the strip in a variety of positions. This arrangement enables the closure flap 84 to fasten in a variety of configurations in order to conform to different sizes of rigid ballistic plate.

Figure 9A:
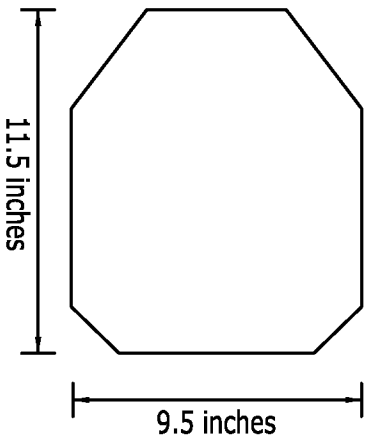
Figure 9B:
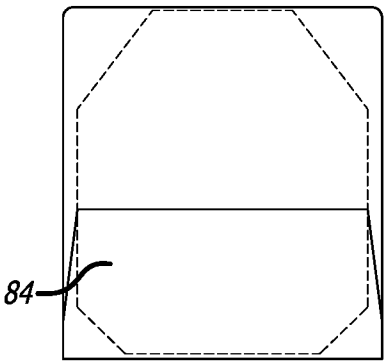
Figure 8A:
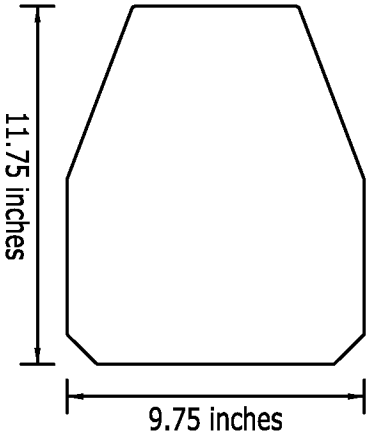
Figure 8B:
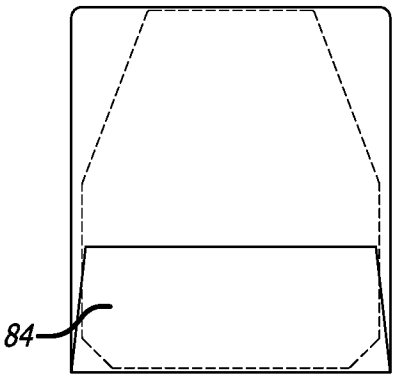
Figure 7A:
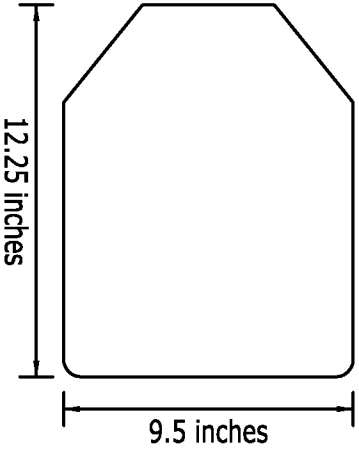
FIGS. 7A/7B, 8A/8B and 9A/9B are elevational views of different ballistic plate and sleeve combinations.
Figure 7B:
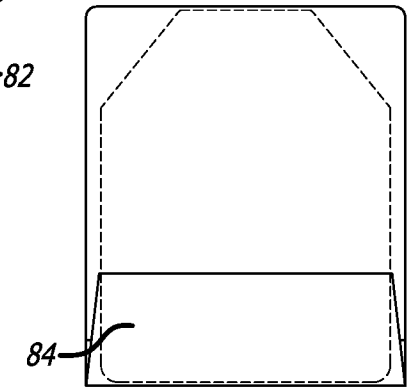

FIGS. 7A/7B, 8A/8B and 9A/9B are elevational views of different ballistic plate and sleeve 80 combinations that can be formed for use in the modified protective vests disclosed herein. As seen in FIGS. 7A, 8A and 9A, ballistic plates come in different sizes and shapes. When inserted within the sleeve 80, the closure flap 84 can be mated in different ways with the hook and loop strip 86 as seen in FIGS. 7B, 8B and 9B.

The plate and sleeve subassembly 32 may be easily expelled from within the chassis 40. First of all, the wearer need only yank on the lower emergency release handle 34 to break the safety ties 54 and pull the subassembly 32 of the chassis 40. Additionally, the sleeve 80 of the subassembly 32 may be made of an extremely low friction polymeric material which facilitates removal of the subassembly from within the chassis 40. One suitable material is an ultrahigh molecular weight polyethylene (UHMWPE) woven composite. One example is sold under the tradename Dyneema, and has an exceptionally slick surface that minimizes friction when removing the subassembly 32 from sometimes highly compressed protective vests.

Figure 10:
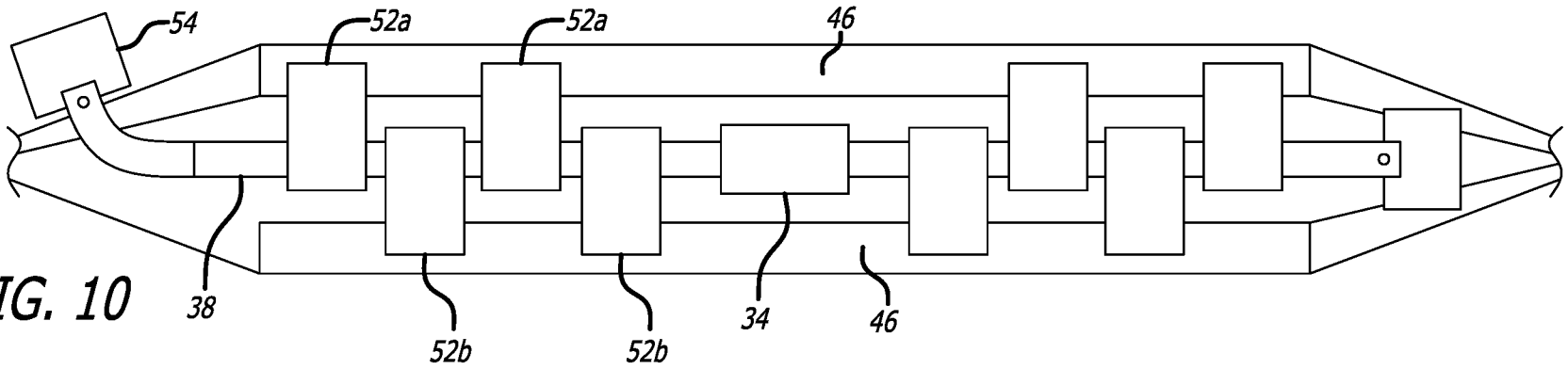
FIG. 10 is a lower end view of the assembled outer chassis and inner ballistic plate and sleeve showing a retention mechanism having a release cable passed through a plurality of fabric retention loops.
Figure 11A:
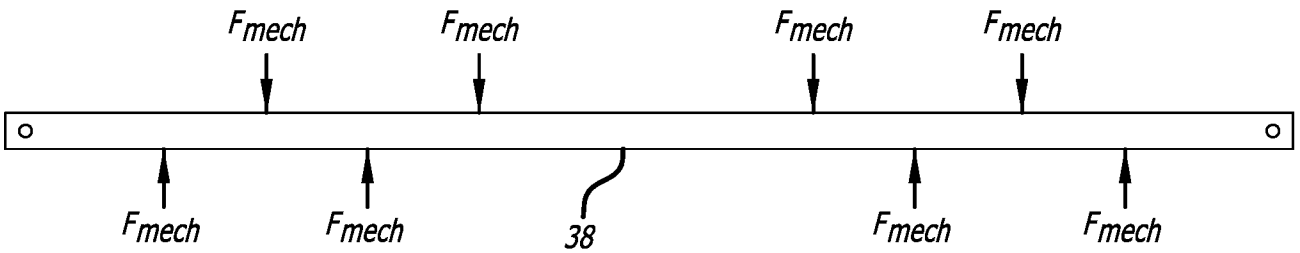
FIG. 11A is a schematic diagram indicating the mechanical forces imparted to the retention mechanism in use.

FIG. 10 is a lower end view of the assembled outer chassis 40 and inner ballistic plate and sleeve showing the retention mechanism having the release cable 38 passed through a plurality of the fabric retention loops 52*a*, 52*b*. This illustrates the passage of the release cable 38 through alternating loops 52 on opposite lower edges 46. FIG. 11A is a schematic diagram indicating the mechanical forces imparted to the retention mechanism in use. That is, the weight of the plate and sleeve subassembly 32 imparts alternating mechanical forces on the release cable 38 which tend to balance one another out, thus putting minimal stress on the safety ties 54 (or other retention device) at each end. More particularly, the downward forces imparted by the weight of the subassembly 32 on the alternating retention loops 52*a*, 52*b* translates into both downward and front-to-rear oriented forces on the loops, which strain the release cable 38 in a serpentine manner. This helps retain the release cable 38 in place and reduces the magnitude of lateral force that reaches the safety ties 54. Consequently, the safety ties 54 can be made relatively lightweight to make breaking them easier, while they are still sufficiently strong to maintain their integrity for extended periods. The safety ties 54 may be made of plastic, such as materials compatible with the anticipated environmental contaminants (nylon or ethylene chlorotrifluoroethylene (ECTFE) beaded safety ties). In the illustrated embodiment there are four retention loops 52*a*, 52*b* on opposite lower edges 46, two on each side, which is believed to be a minimum suitable number to provide adequate holding force.

Figure 11B:
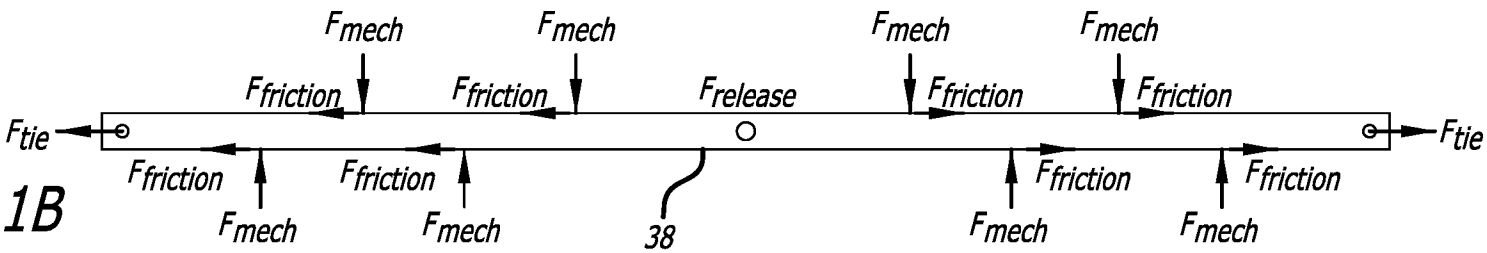
FIG. 11B is a diagram indicating forces acting on a release cable of the retention mechanism during actuation.

FIG. 11B is a diagram indicating forces acting on the release cable 38 of the retention mechanism during actuation. Namely, the only forces acting laterally are the reaction forces $F_{tie}$ from pulling on the safety ties 54, as well as minimal frictional forces $F_{friction}$ imparted by the retention loops 52*a*, 52*b* on the cable 38. This reduces the amount of force needed to pull the release cable 38 from within the retention mechanism 50, thus releasing the plate and sleeve subassembly 32 to be pulled free or drop from the chassis 40. Moreover, the release cable 38 may be made of polytetrafluoroethylene (PTFE or Teflon) which has low friction, is capable of withstanding large surface normal forces, has a wide service temperature range, does not embrittle or age, and is flame resistant, making it an excellent candidate for naval aviation environments.

Figure 12:
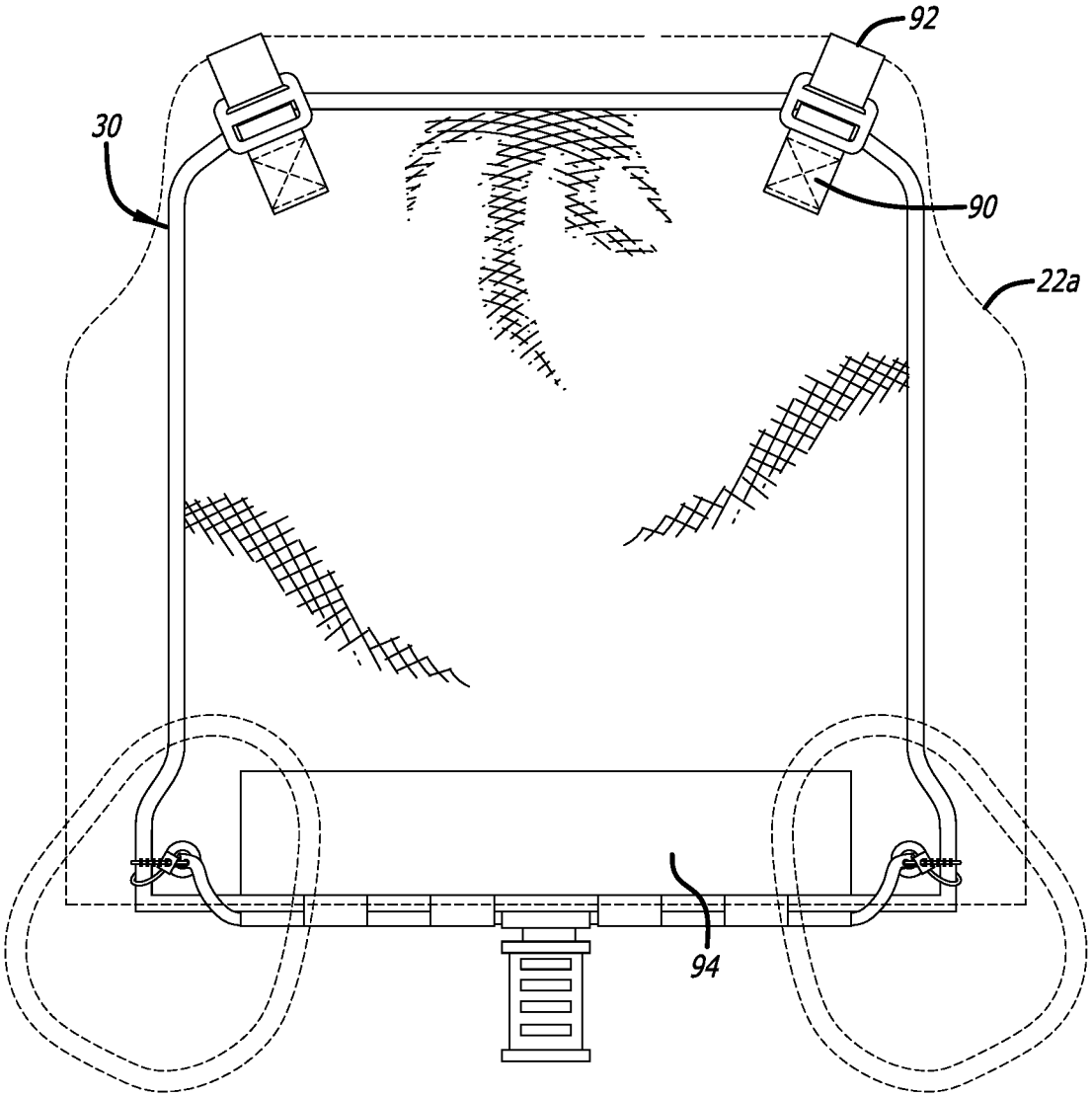
FIG. 12 is an elevational view illustrating one way to mount a quick-release ballistic plate assembly to a chest panel and/or back panel of a protective vest shown in phantom.

FIG. 12 is an elevational view illustrating one way to mount a quick-release ballistic plate assembly 30 to a chest panel 22*a* (or back panel 22*b*) of a protective vest shown in phantom. The ballistic plate assembly 30 has a pair of buckle straps 90 or other such interlocking load bearing elements secured thereto at upper lateral corners. Mating buckle straps 92 are added to the rear face of the chest panel 22*a* near upper lateral corners as well. These can easily be added at the OEM level or retrofitted to existing protective vests with stitching. The mating buckle straps 90, 92 support the majority of the weight of the assembly 30 including the ballistic plate therein. A lower hook and loop strip 94 on a front face of the assembly 30 engages a mating hook and loop strip (96 in FIG. 15) on the rear face of chest panel 22*a*. Again, such a mating hook and loop strip is easily stitched to the chest panel 22*a*. Thus, simply adding two buckle straps 92 and a strip of hook and loop fastener to each chest panel 22*a*, 22*b* retrofits the protective vest 20 to receive front and rear quick-release ballistic plate assemblies 30.

Figure 13B:
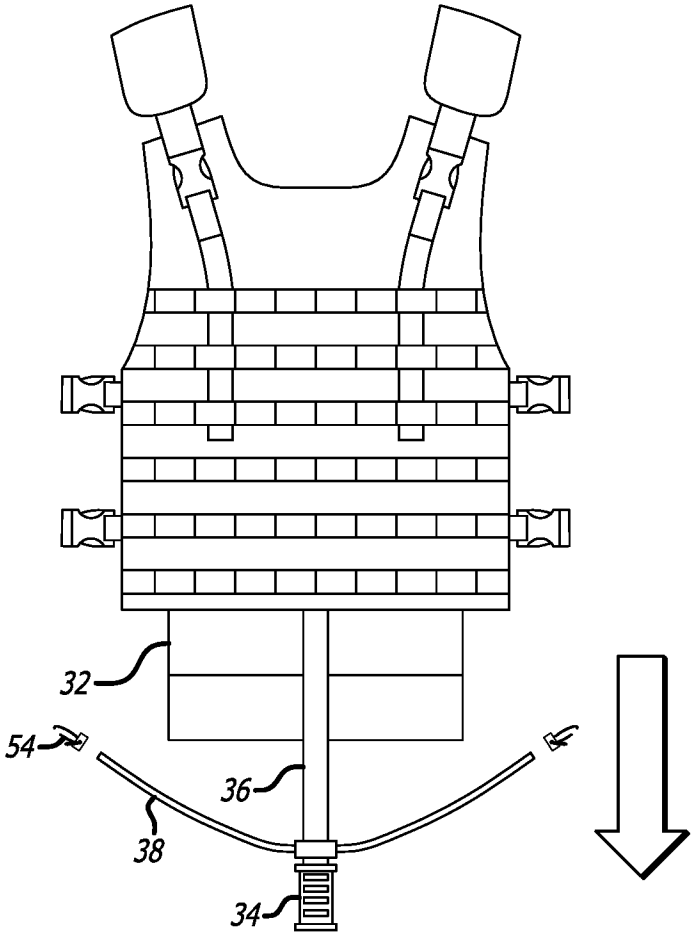
FIG. 13B shows the actuation of the system, releasing the ballistic plate and sleeve subassembly from the vest.
Figure 13A:
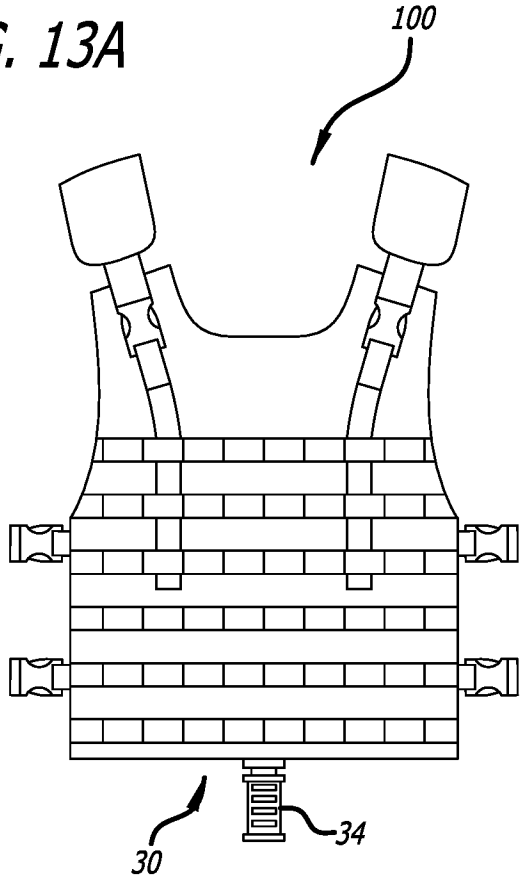
FIG. 13A is an elevational view of an alternative protective vest outfitted with a quick-release ballistic plate assembly.

FIG. 13A is a perspective view of an alternative modified protective vest 100 outfitted with a quick-release ballistic plate assembly 30 of the present application. This type of vest is often known in the industry as PRU-70. FIG. 13B shows the ballistic plate and sleeve subassembly 32 being separated from the vest in the same manner as above; by pulling down on the emergency release handle 34 to break the safety ties 54.

Figure 14:
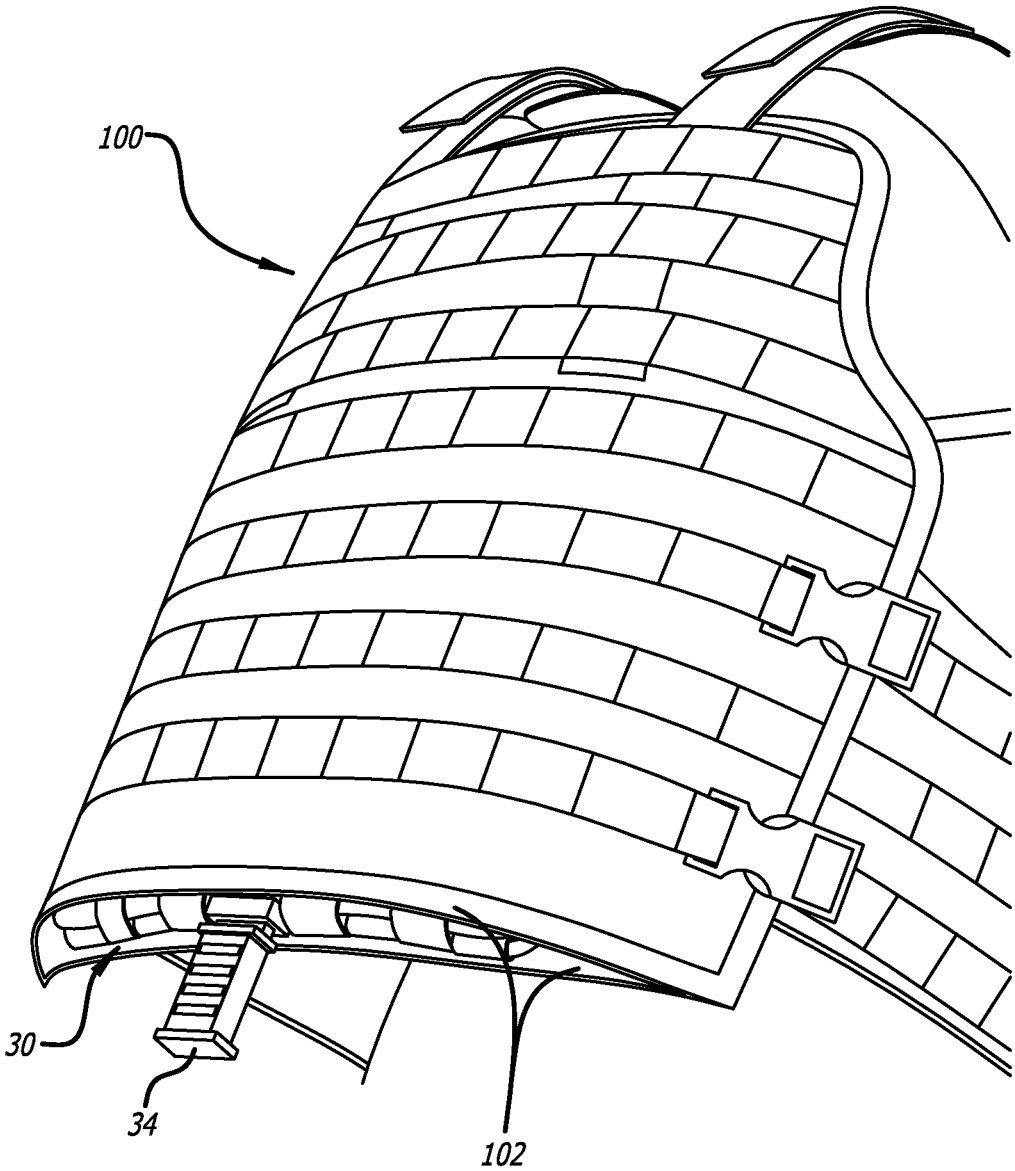
FIG. 14 is perspective view looking upward at the alternative protective vest of FIG. 13A showing one way to retrofit a quick release ballistic plate assembly therewith.

FIG. 14 is perspective view from a lower perspective of the alternative protective vest 100 of FIG. 13A showing one way to retrofit a quick release ballistic plate assembly 30 therewith. Namely, this type of vest includes an interior cavity opening downward and bordered by two lower edges 102. The assembly 30 is inserted upward into the cavity and held therein by buckles, fasteners, or the like.

Figure 15:
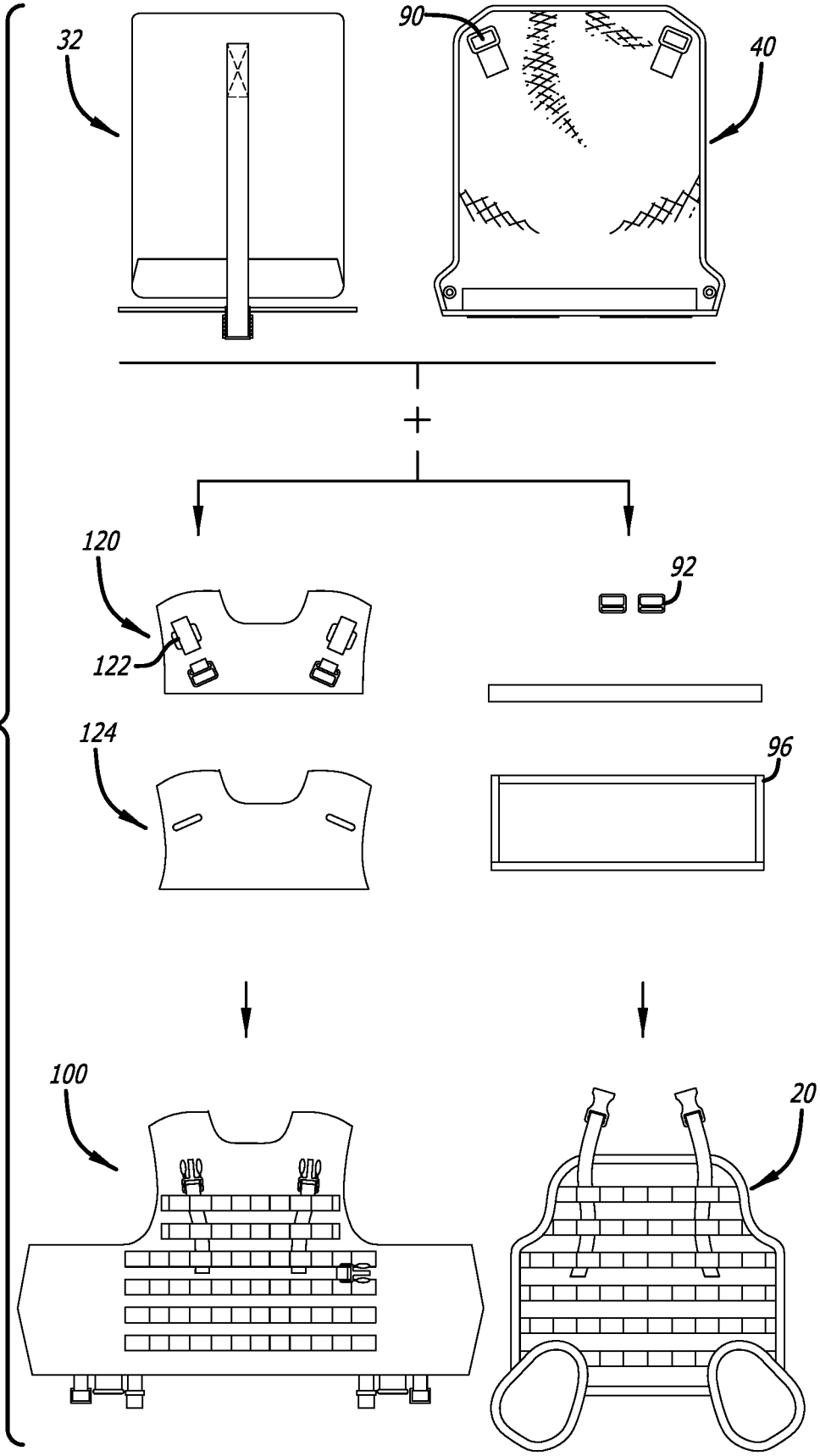
FIG. 15 is a schematic diagram of the retrofitting process for two exemplary protective vests.

FIG. 15 is a schematic diagram of the retrofitting process for two exemplary types of protective vests 20, 100. The combination of the plate/sleeve subassembly 32 into the chassis 40 to form the quick-release ballistic plate assembly 30 is the same, regardless of vest type. From there, installation of the hook tape, anchors and replacement panel (if needed) changes depending on the vest type. Templates are utilized to guide retrofit fabrication. An anchor placement template 120 locates the mating buckles/straps 122 within the cavity that are configured to mate with the buckles 90 on the exterior of the chassis 40. An outer stitching position template 124 is then held in stable position on the exterior of the vest 100 to guide the technician as to where to sew the buckles/straps 122 within the cavity. The outer stitching position template 124 can then be removed, as it may be paper, while the anchor placement template 120 may remain in place or be ripped out as well, as it does not impede attachment of the ballistic plate assembly 30.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. An apparatus comprising a quick-release ballistic plate assembly for a protective vest, comprising:

an outer chassis having a pair of flexible flat panels connected together at outer top and side edges thereof, with aligned lower edges unconnected to define an open lower mouth leading upward to an inner cavity between the panels, the outer chassis having attachment structure thereon for mounting to the protective vest;

a ballistic plate and sleeve subassembly having a rigid ballistic plate held within a flat sleeve made of low friction polymer, the subassembly being sized to fit through the lower mouth of the outer chassis into the cavity, and the subassembly having an emergency release handle centered on one end thereof; and a subassembly retention mechanism having a release cable fixed to the emergency release handle and passed laterally outward through a plurality of flexible retention loops hanging down from the aligned lower edges of the outer chassis, wherein opposite lateral ends of the release cable are affixed to the outer chassis by retention devices, and wherein the retention devices have sufficient strength to retain the release cable in place against a weight of the subassembly while being configured to break from manual downward pulling on the emergency release handle.

2. The apparatus of claim 1, wherein the low friction polymer of the sleeve is ultrahigh molecular weight polyethylene.

3. The apparatus of claim 2, wherein the sleeve has a hook and loop closure at a lower end with a loose flap configured to mate with a strip on an exterior panel, and wherein the flap has a larger hook and loop dimension than the strip to enable the flap to mate with the strip in a variety of positions to change an overall outer dimension of the sleeve and contain differently-sized ballistic plates.

4. The apparatus of claim 1, wherein the sleeve has a hook and loop closure at a lower end with a loose flap configured to mate with a strip on an exterior panel, and wherein the flap has a larger hook and loop dimension than the strip to enable the flap to mate with the strip in a variety of positions to change an overall outer dimension of the sleeve and contain differently-sized ballistic plates.

5. The apparatus of claim 1, wherein the release cable is made of polytetrafluoroethylene.

6. The apparatus of claim 5, wherein there are at least four retention loops hanging down from each lower edge of the outer chassis.

7. The apparatus of claim 1, wherein the attachment structure on the outer chassis for mounting to the protective vest comprises two interlocking load bearing elements at upper lateral corners and at least one hook and loop patch at a lower end thereof, each configured to engage mating structure provided on the protective vest.

8. The apparatus of claim 1, wherein the outer chassis including the retention loops is made of nylon.

9. The apparatus of claim 1 further comprising the protective vest.

10. A method of retrofitting a protective vest, including:

removing any panels used to contain a rigid plate from a chest or back panel of a protective vest;

adding mating structure to the chest or back panel, the mating structure configured to engage the attachment structure on the outer chassis of the assembly of claim 1; and attaching the assembly of claim 1 to the chest or back panel such that the emergency release handle depends downward lower than a lower edge of the chest or back panel.

11. The method of claim 10 wherein the chest or back panel of the protective vest has a downwardly-opening inner cavity within which the assembly of claim 1 is inserted.

12. An apparatus comprising a quick-release ballistic plate assembly for a protective vest, comprising:

an outer chassis having a pair of flexible fabric panels connected together at outer top and side edges thereof, with lower edges unconnected to define an open lower mouth leading upward to an inner cavity between the panels, the outer chassis being mounted to the protective vest such that the lower mouth is positioned adjacent a lower extent of a chest or back panel of the protective vest;

a ballistic plate and sleeve subassembly having a rigid ballistic plate held within a flat sleeve made of low friction polymer, the subassembly being sized to fit through the lower mouth of the outer chassis into the cavity, and being held therein by a subassembly retention mechanism;

the subassembly having an emergency release handle centered on a lower end thereof that depends downward below the lower extent of the chest or back panel of the protective vest, and the subassembly retention mechanism having sufficient strength to retain the subassembly in place within the cavity of the outer chassis while being configured to break from manual downward pulling on the emergency release handle.

13. The apparatus of claim 12 wherein the subassembly retention mechanism includes a release cable fixed to the emergency release handle and passed laterally outward through a plurality of flexible retention loops hanging down from the aligned lower edges of the outer chassis, wherein opposite lateral ends of the release cable are affixed to the outer chassis.

14. The apparatus of claim 13 wherein the opposite lateral ends of the release cable are affixed to the outer chassis by safety ties, and wherein the safety ties have sufficient strength to retain the release cable in place against a weight of the subassembly while being configured to break from manual downward pulling on the emergency release handle.

15. The apparatus of claim 13 wherein the release cable is made of polytetrafluoroethylene.

16. The apparatus of claim 15 wherein there are at least four retention loops hanging down from each lower edge of the outer chassis.

17. The apparatus of claim 12 wherein the low friction polymer of the sleeve is ultrahigh molecular weight polyethylene.

18. The apparatus of claim 17 wherein the sleeve has a hook and loop closure at a lower end with a loose flap configured to mate with a strip on an exterior panel, and wherein the flap has a larger hook and loop dimension than the strip to enable the flap to mate with the strip in a variety of positions to change an overall outer dimension of the sleeve and contain differently-sized ballistic plates.

19. The apparatus of claim 12 wherein the sleeve has a hook and loop closure at a lower end with a loose flap configured to mate with a strip on an exterior panel, and wherein the flap has a larger hook and loop dimension than the strip to enable the flap to mate with the strip in a variety of positions to change an overall outer dimension of the sleeve and contain differently-sized ballistic plates.

20. The apparatus of claim 12 wherein the outer chassis comprises two interlocking load bearing elements at upper lateral corners for mounting to mating interlocking load bearing elements on the protective vest, and the outer chassis has at least one hook and loop patch at a lower end thereof configured to engage mating hook and loop structure provided on the protective vest.

21. The apparatus of claim 12, wherein the outer chassis including the retention loops is made of nylon.

22. The apparatus of claim 12 further comprising the protective vest.

* * * * *